US005420563A

United States Patent [19]

Frigo

[11] Patent Number: 5,420,563

[45] Date of Patent: May 30, 1995

[54] MOTOR-VEHICLE HORN

[75] Inventor: Domenico Frigo, Vincenza, Italy

[73] Assignee: F.I.A.M.M. Componenti Accessori-F.C.A. S.p.A., Vicenza, Italy

[21] Appl. No.: 182,130

[22] PCT Filed: Jul. 8, 1992

[86] PCT No.: PCT/EP92/01538

§ 371 Date: Mar. 11, 1994

§ 102(e) Date: Mar. 11, 1994

[87] PCT Pub. No.: WO93/01588

PCT Pub. Date: Jan. 21, 1993

[30] Foreign Application Priority Data

Jul. 12, 1991 [IT] Italy ..... TO91A0548

[51] Int. Cl.[6] ..... G08B 3/00

[52] U.S. Cl. ..... 340/388.1; 340/388.5; 340/391.1; 116/137 R; 116/142 R; 181/159; 181/144

[58] Field of Search ..... 340/388.1, 388.2, 388.4, 340/388.5, 388.7, 388.3, 391.1, 393.1, 397.1, 397.3, 396.1; 116/137 R, 142 R; 181/157, 159, 175, 152, 144

[56] References Cited

U.S. PATENT DOCUMENTS 4,241,334 12/1980 Shintaku ..... 340/388.1

FOREIGN PATENT DOCUMENTS

| | | |
|---|---|---|
| 696758 | 9/1967 | Belgium . |
| 2371035 | 6/1978 | France . |
| 2518293 | 6/1983 | France . |
| 422563 | 12/1925 | Germany . |
| 481468 | 8/1929 | Germany . |
| 1131123 | 6/1962 | Germany . |
| 808990 | 2/1959 | United Kingdom . |
| 2041616 | 9/1980 | United Kingdom . |
| 04289 | 7/1987 | WIPO . |

*Primary Examiner*—Donnie L. Crosland
*Attorney, Agent, or Firm*—Edward D. Manzo; Ted K. Ringsred

[57] ABSTRACT

The horn includes a support casing (1 to 3) in which the peripheries of two facing diaphragms (10, 11) are restrained, a chamber (12) of variable volume being defined between the diaphragms (10, 11) and communicating with a sound-emission duct (50, 51, 70). Respective, opposed ferromagnetic armatures (17, 18) are connected to the diaphragms (10, 11). When a control solenoid (15) is excited by an intermittent current, it causes the armatures (17, 18) to move in opposition and the diaphragms (10, 11), to vibrate in counterphase.

26 Claims, 8 Drawing Sheets

MOTOR-VEHICLE HORN

The present invention relates to motor-vehicle horns.

More specifically, the subject of the invention is a horn of the type including:

- a support casing,
- a diaphragm connected peripherally to the casing and constituting one wall of a chamber of variable volume,
- a sound-emission duct communicating with the chamber,
- a control solenoid fixed in the casing, and
- a ferromagnetic armature which is connected to the diaphragm and at least part of which extends movably in the solenoid so as to cause the diaphragm to vibrate along a predetermined axis when the control solenoid is excited by an intermittent current.

A horn of this type is described, for example, in U.S. Pat. No. 4,135,473.

In electromagnetic horns of this type which have been produced up to now, the mass which is made to oscillate as a result of the intermittent excitation of the control solenoid is usually between about 15 and 70 g and typically 40–50 g. The oscillation of such a mass generates reactions in the support casing of the horn. These reactions reate problems of two kinds. In the first place, they involve the need to introduce damping in order not to cause the bodywork of the motor vehicle to which the horn is connected to vibrate, which could generate noise.

Moreover, the support casing of the horn must move relative to the diaphragm in a suitable manner since otherwise the level of sound generated would be compromised to an extend depending on the phase relationship between the oscillations of the support casing and of the internal oscillating mass.

If a horn of the conventional type defined above is not connected properly to the bodywork of the motor vehicle, there may be an intolerable decline in the sound emitted. It is therefore necessary to take particular care withe the mounting of this type of horn, which is usually done with the use of brackets of a suitable design.

A first object of the invention is to provide a motor-vehicle which is not subject to the problems and disadvantages outlined above.

According to the invention, this object is achieved by a horn of the type defined above, the main characteristic of which lies in the fact that it also includes:

- a second diaphragm which is also connected peripherally to the casing and which is spaced from and faces the first diaphragm so as to constitute a second wall of the variable-volume chamber, and
- a second movable ferromagnetic armature connected to the second diaphragm, facing the first armature and separated therefrom at least by an air gap, the second armature being adapted, together with the first armature and the air gap, to form a magnetic circuit which is affected by the flux generated by the at least one control solenoid so that the intermittent excitation of the solenoid correspondingly causes the armatures to move in opposition and the diaphragms to vibrate in counterphase.

The horn according to the invention thus has two oscillating units, preferably of equal mass, which vibrate in counterphase and are mutually balanced. Any reaction of the support casing or cover against the bodywork of the motor vehicle, as well as the resulting troublesome problems of horns of the prior art, are thus practically eliminated.

The horn according to the invention is also characterised by a number of further improvements to which the appended claims relate.

Further characteristics and advantages of the invention will in any case become clear from the detailed description which follows, with reference to the appended drawings, provided purely by way of non-limiting example, in which.

Figure 2:
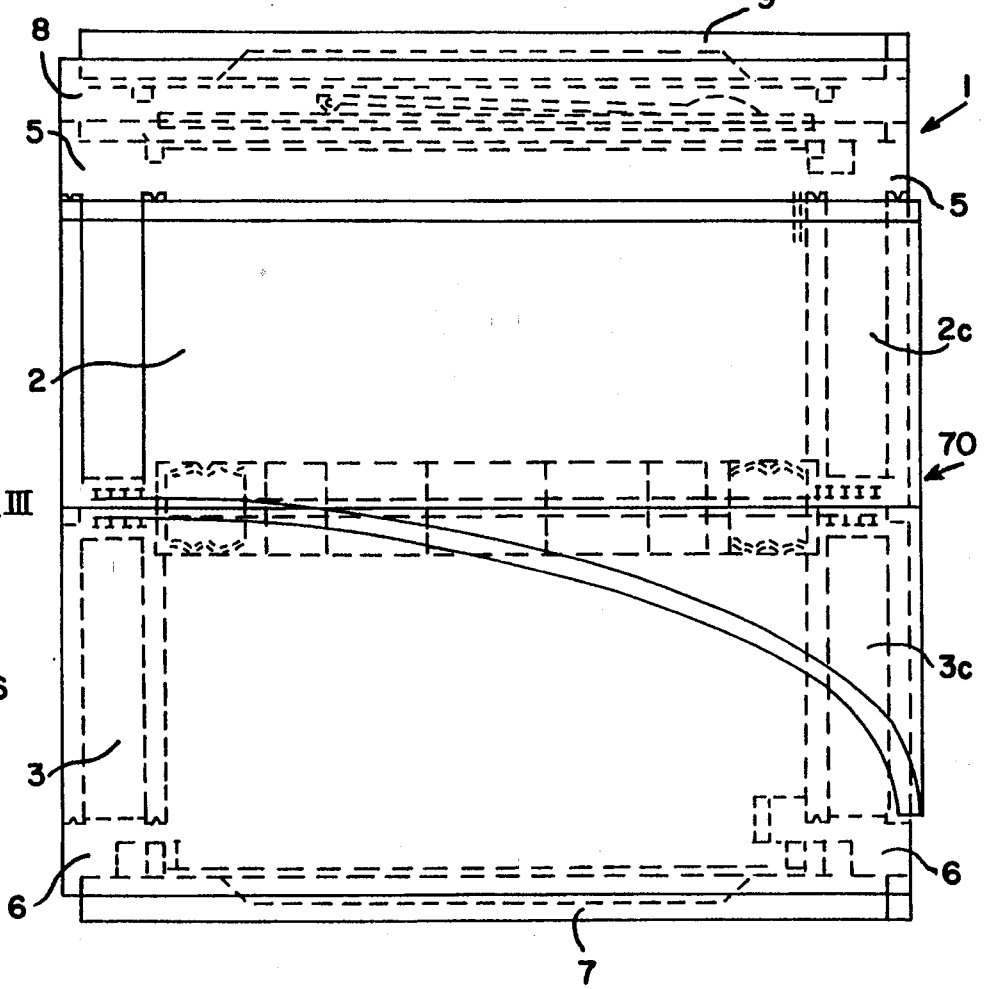
FIG. 2 is a side view of the horn taken on the arrow II of FIG. 1.
Figure 1:
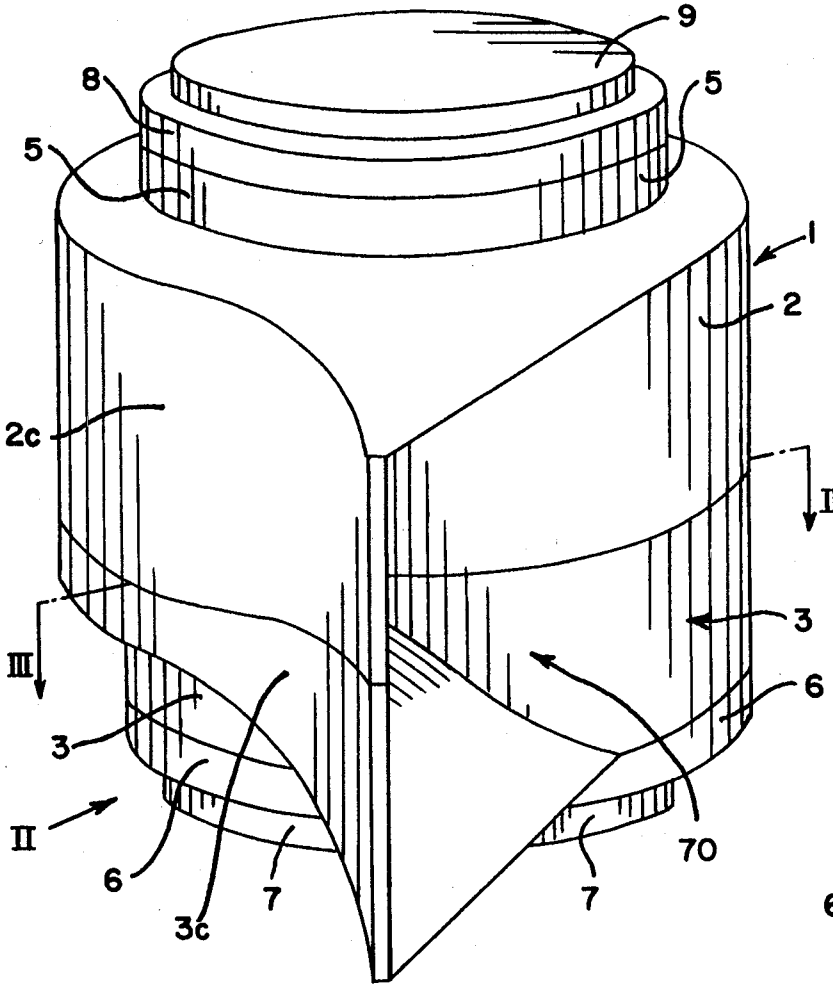
FIG. 1 is a perspective view of a horn according to the invention.
Figure 3:
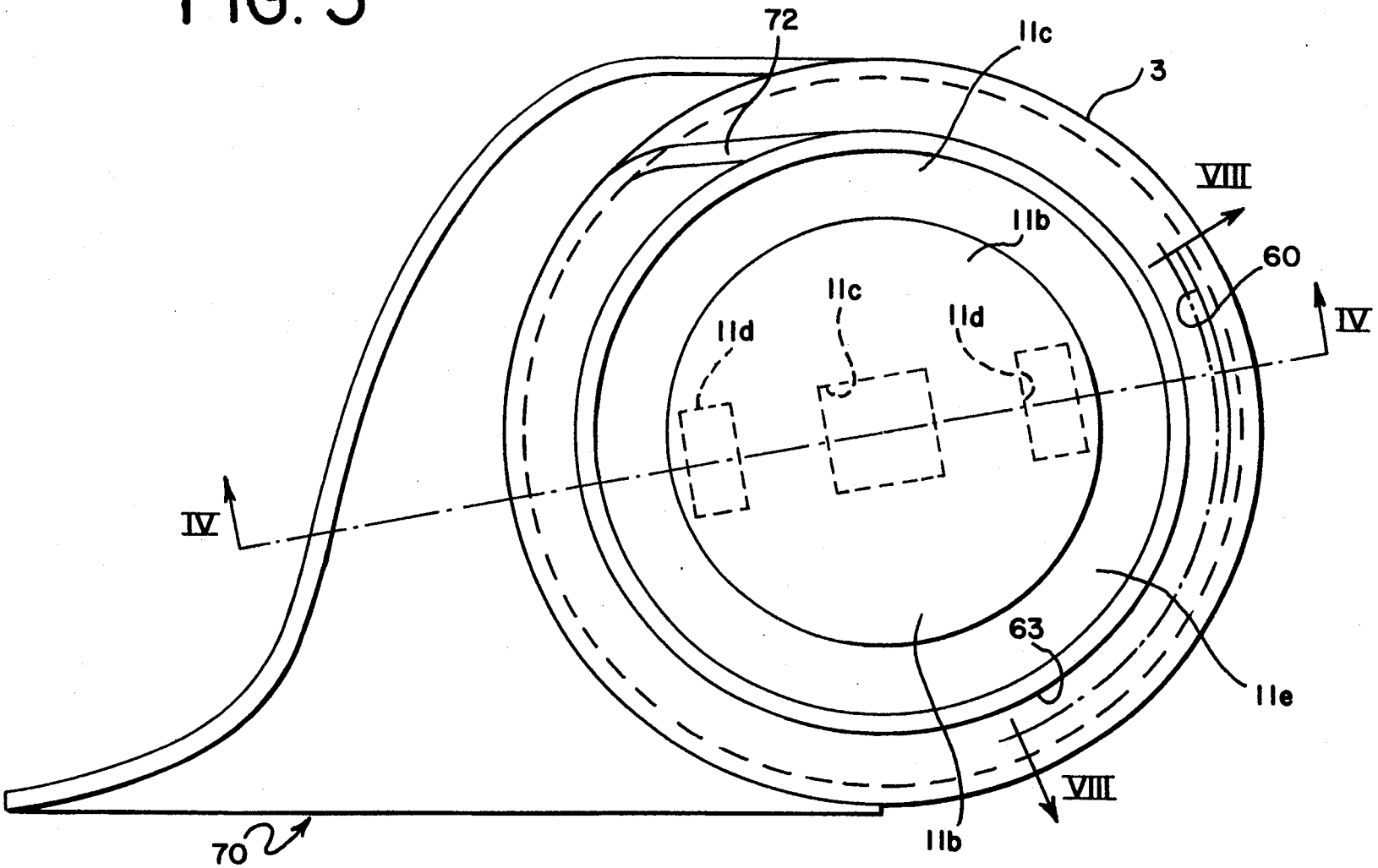
FIG. 3 is a section taken on the line III—III of FIG. 1.
Figure 5:
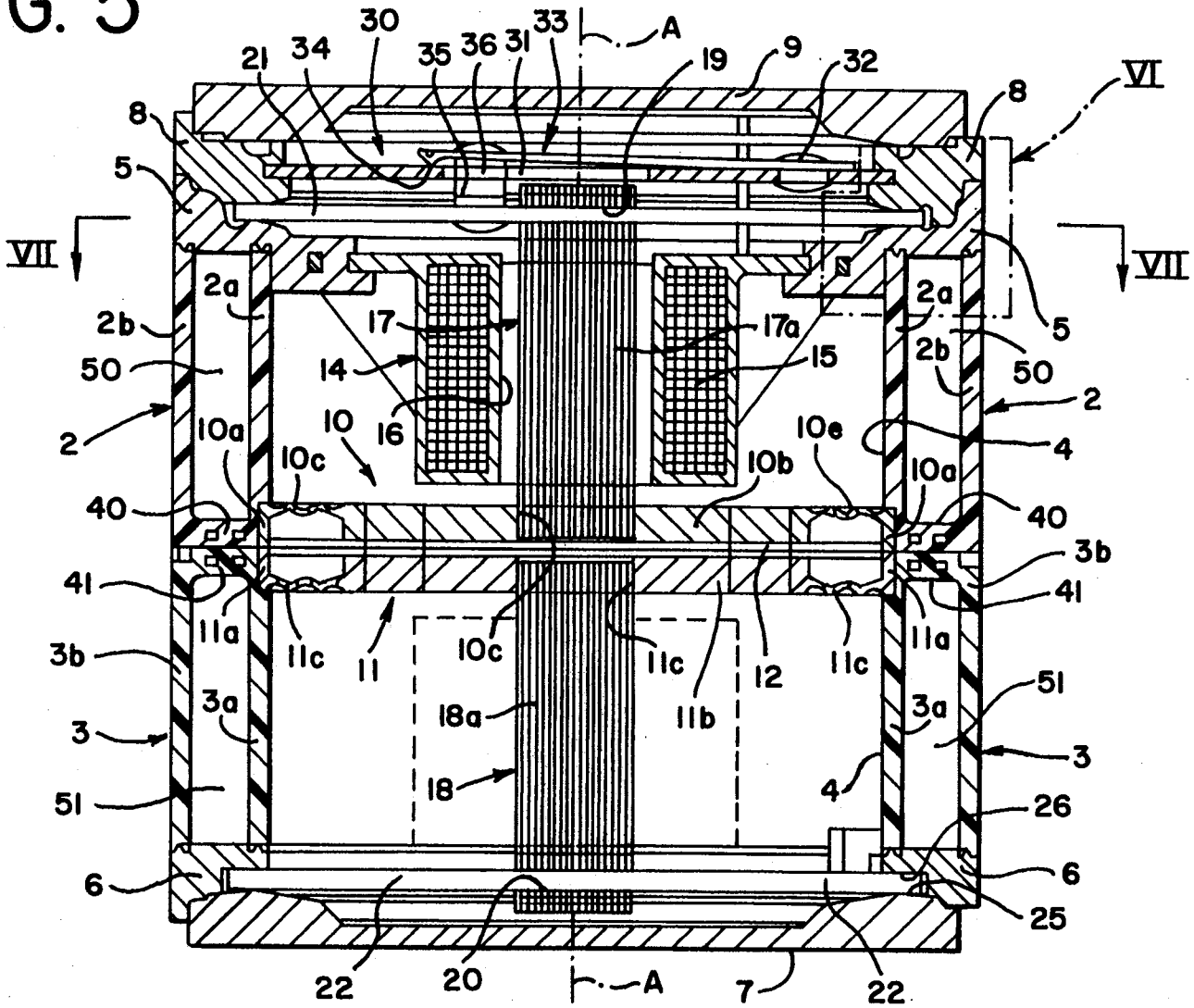
FIG. 5 is a section taken on the line V—V of FIG. 4.
Figure 6:
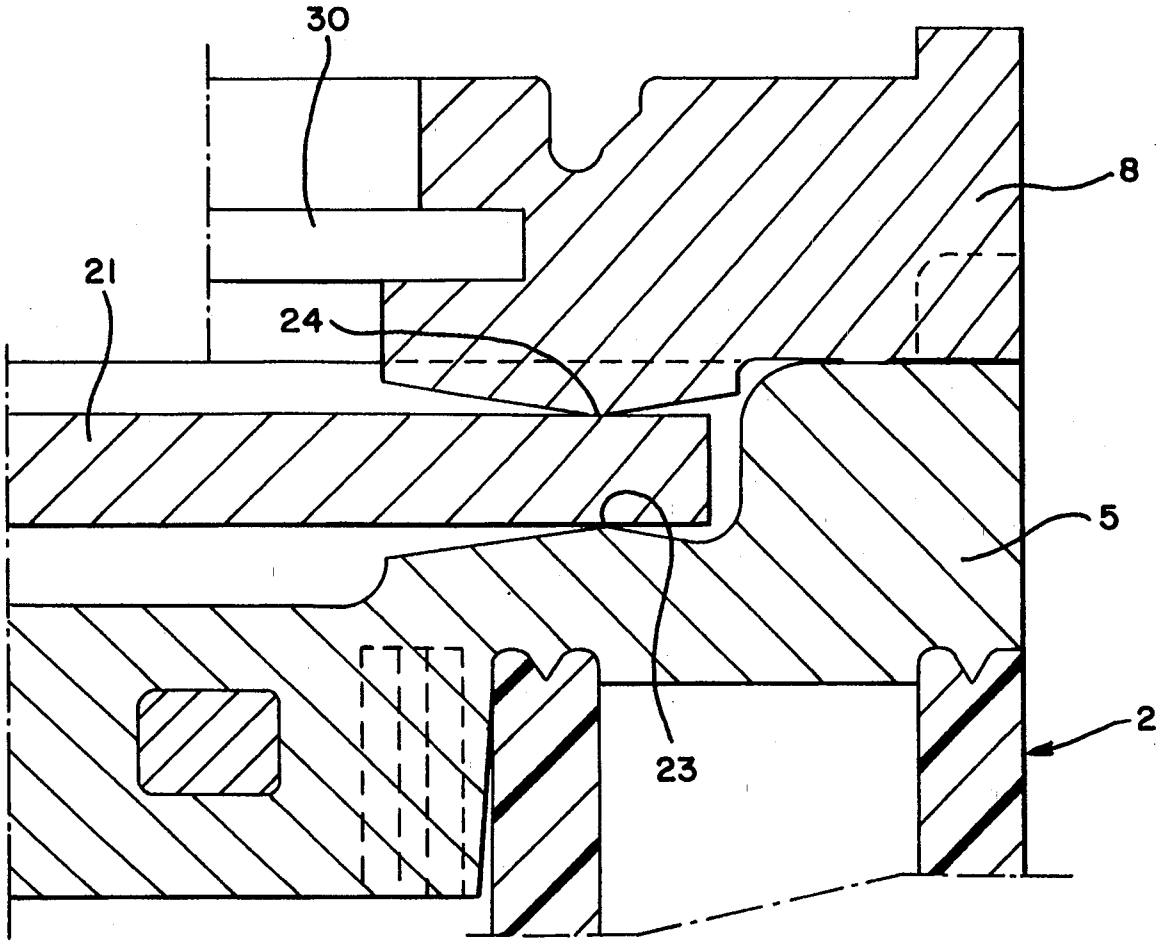
Figure 7:
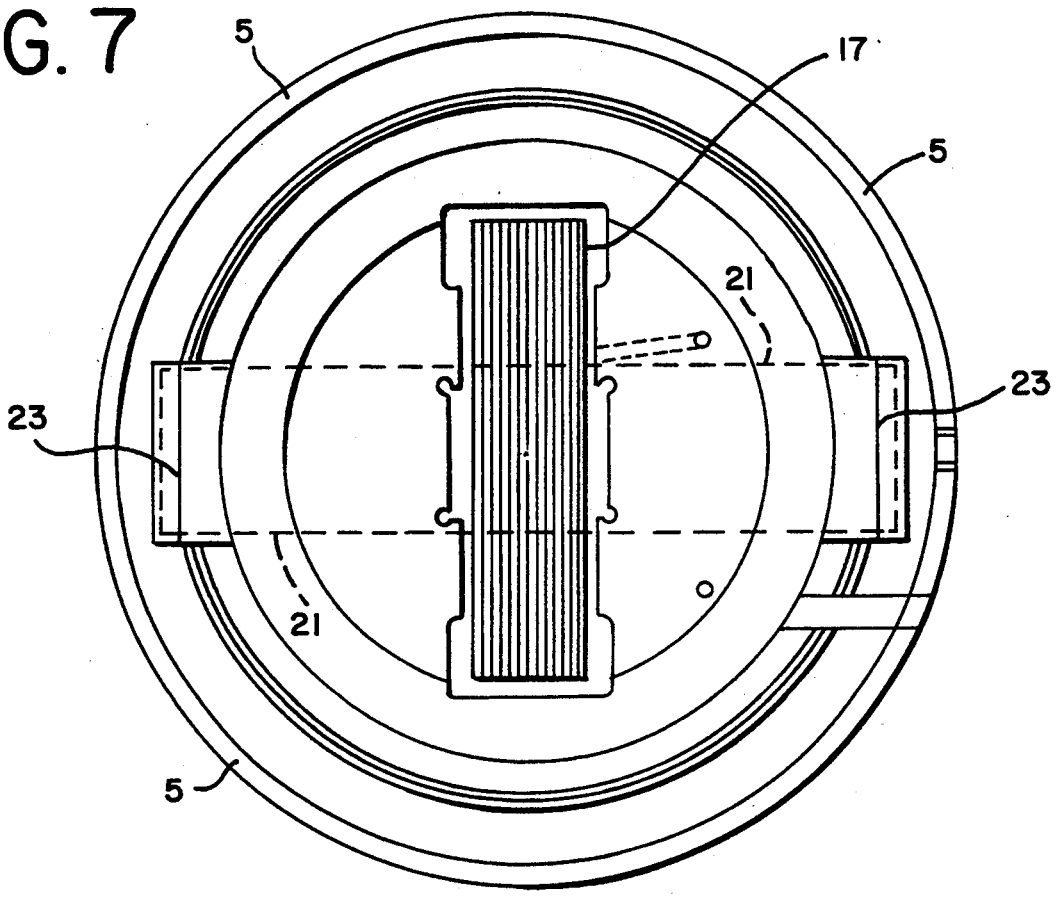
Figure 8:
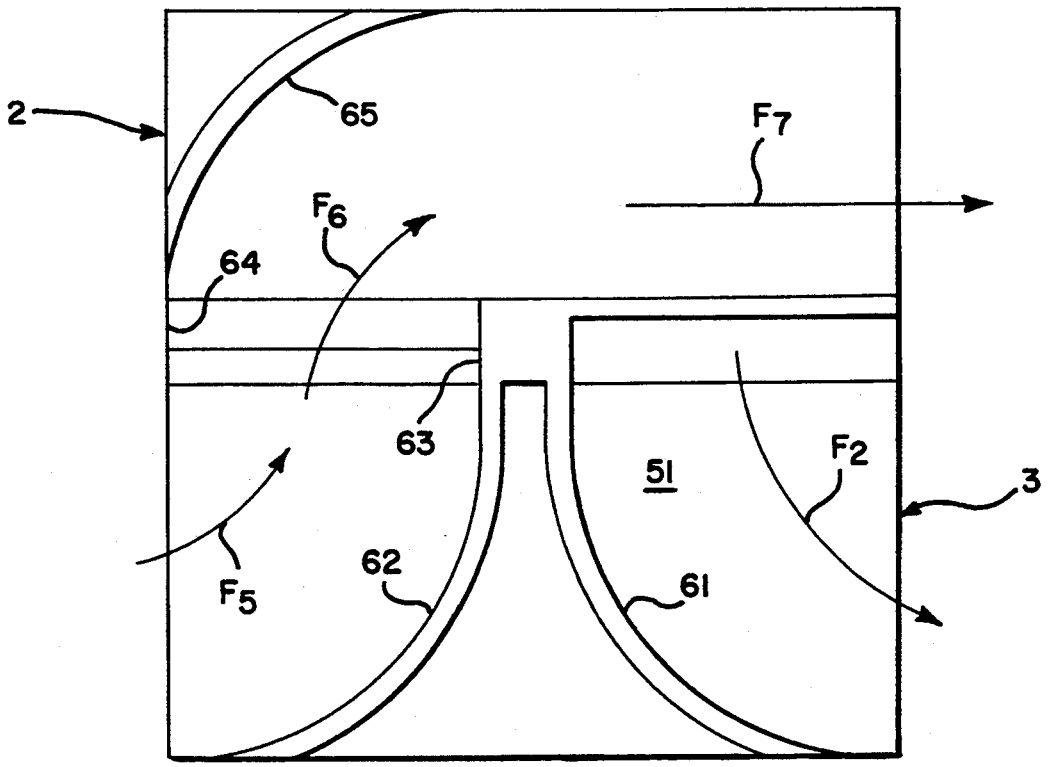
Figure 9:
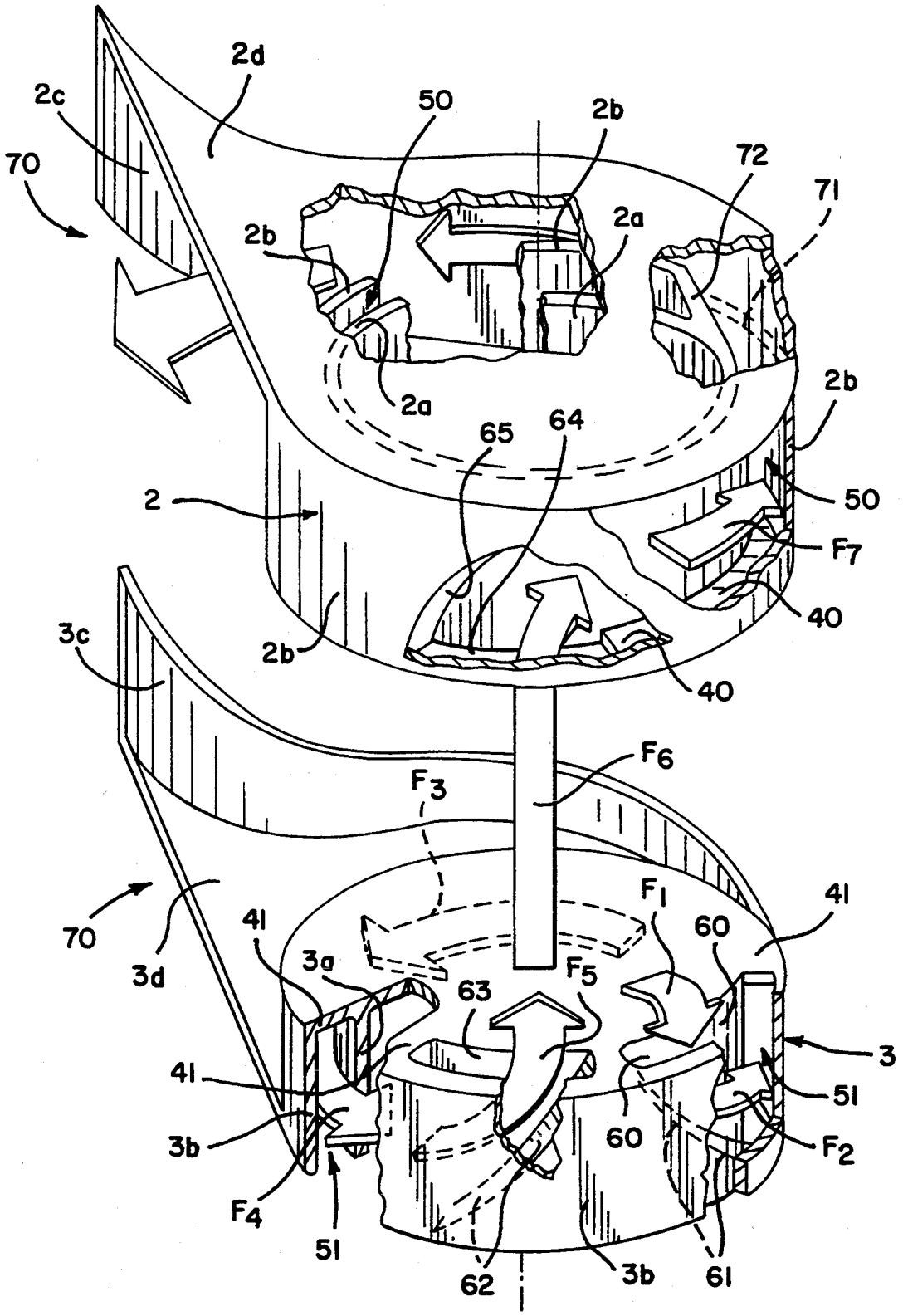
Figure 10:
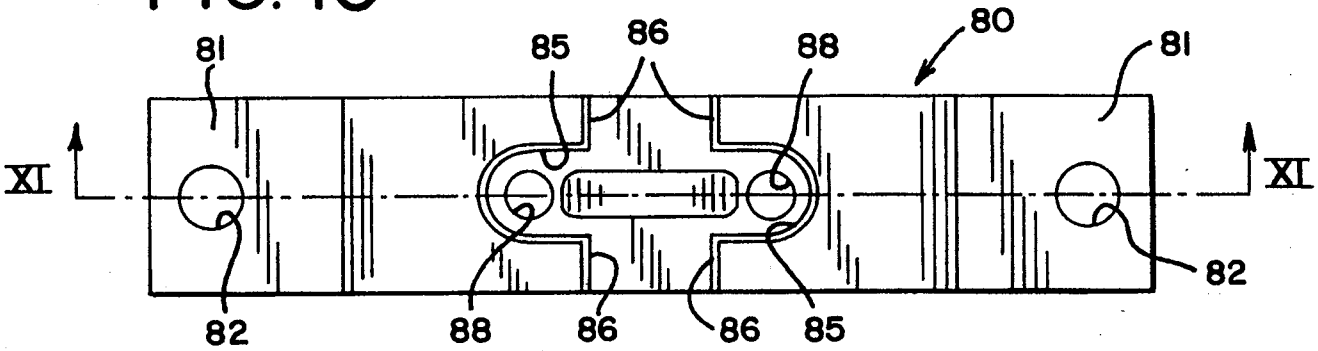
Figure 11:
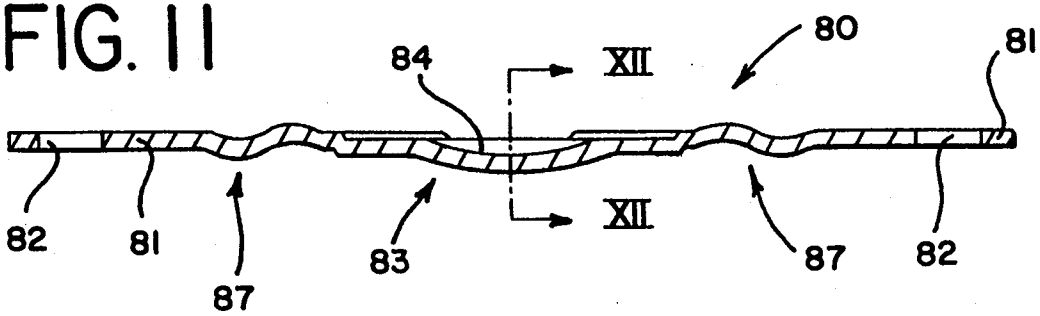
Figure 12:
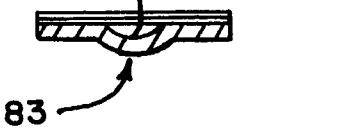

FIG. 6 is a view of a detail indicated VI in FIG. 5, on an enlarged scale, FIG. 7 is a section taken on the line VII—VII of FIG. 5, FIG. 8 is a partial view taken on the curved section line VIII—VIII of FIG. 3, FIG. 9 is a partially-sectioned, exploded, partial perspective view of the horn of the preceding drawings, FIG. 10 is a plan view of a resilient plate usable in the horn according to the invention, FIG. 11 is a section taken on the line XI—XI of FIG. 10, and FIG. 12 is a cross-section taken on the line XII—XII of FIG. 11.

With reference to the drawings, a motor-vehicle horn according to the invention includes a support casing, generally indicated 1. In the embodiment shown by way of example (see, in particular, FIGS. 4 and 5) the casing includes two shaped elements 2 and 3 of plastics material (for example, ABS plastics) disposed one upon the other.

The elements define a cylindrical cavity 4 and respective support rings, indicated 5 and 6, are connected to their ends. The casing 1 is closed at the bottom by a circular cover 7 which is connected to the ring 6. A further support ring 8 is disposed above the ring 5 and, finally, the casing is closed at the top by a cover, indicated 9, which conveniently is the same as the cover 7.

The rings 5, 6 and 8 and the end covers 7 and 9 are also made of a plastics material.

Conveniently, the shaped elements 2 and 3, the support rings, and the end covers, are welded together, for example by ultrasonic welding.

Figure 4:
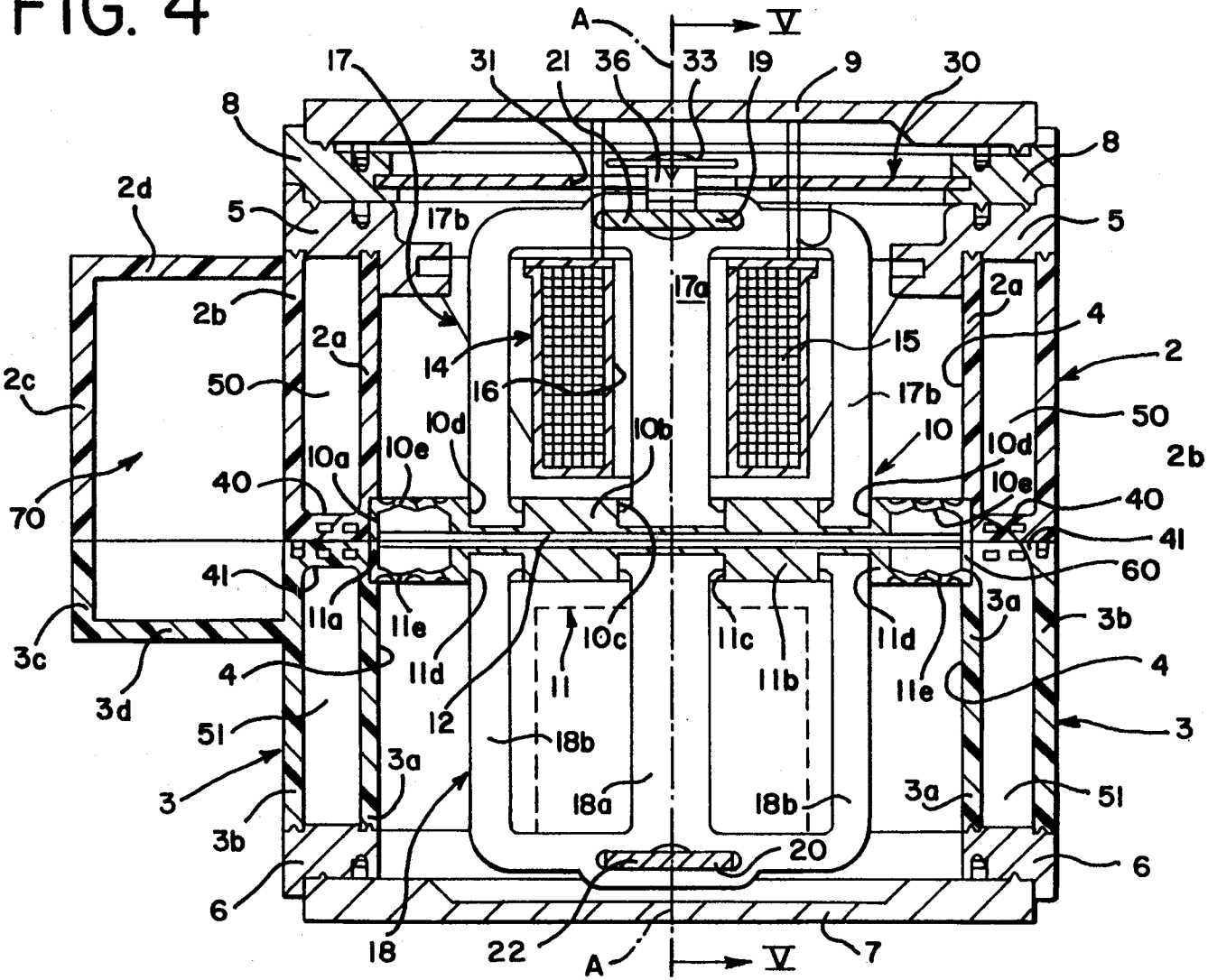
FIG. 4 is a section taken on the line IV—IV of FIG. 3.

As can be seen from FIGS. 4 and 5, the peripheral portions 10*a*, 11*a* of two diaphragms which face each other a short distance apart are clamped between the two shaped elements 2 and 3 in the cavity 4 of the casing.

With suitably selected materials, the diaphragms may, however, be integral with the shaped elements 2 and 3 or may be made of different materials and comoulded with the shaped elements.

Conveniently, each membrane 10, 11 has a central, relatively thick and stiff, disc-shaped portion 10*b*, 11*b* (FIG. 5). Each disc-shaped portion has a central, recessed seat or depression 10*c*, 11*c* (FIGS. 4 and 5) and two lateral recessed seats or depressions 10*d*, 11*d* (FIGS. 3 and 4). The seats face the end covers 9 and 7, respectively.

Between its periphery and its central disc-shaped portion, each diaphragm has a thinner, flexible, annular, intermeditate portion 10*e* with a corrugated, bellows-like radial profile.

The volume of a chamber 12 defined between the diaphragms 10 and 11 varies, in operation, according to the relative positions of the diaphragms.

Conveniently, in order to faciliate the flow of air to and from the chamber 12 and to increase the opening through which the air passes towards the sound-emission duct described below, the bellows-like annular portions 10*e*, 11*e* of the diaphragms form the base walls of two annular recesses or ducts in the facing surfaces of the diaphragms (FIGS. 4 and 5).

The diaphragms 10 and 11 are conveniently made of a plastics material, preferably a toughened acetal resin, so that they can operate even at fairly low temperatures and are resistant to fatigue stresses.

The support ring 5 carries a central reel-like support structure 14 of electrically insulating material which carries a control winding or solenoid 15 (see FIG. 5 in particular). The solenoid is coaxial with the longitudinal azis A—A of the cylindrical cavity 4 above the upper diaphragm 10.

The reel-like structure 14 which carries the solenoid is firmly connected to the ring 5, for example, as a result of a co-moulding operation, and is thus firmly fixed to the casing 1.

Two substantially E-shaped packs of ferromagnetic plates, indicated 17 and 18, are disposed opposite each other with their central arms 17*a*, 18*a* and their side arms 17*b* and 18*b* facing and aligned (FIG. 4).

Near the bases of their respective central arms 17*a*, 18*a*, the packs of plates or armatures 17 and 18 have respective slots, indicated 19 and 20. A respective elongate, rectangular, flexible metal plate is driven through the slot in each pack or armature.

As can be seen in FIGS. 5 to 7, the ends of the metal plate 21 associated with the armature 17 are supported between a pair of bearings 23 (FIG. 6) in the annular element 5 and a corresponding pair of counter-bearings 24 in the overlying annular element 8. As can be seen in FIG. 6 in particular, the bearings and the counter-bearings are constituted essentially by edges formed by dihedral pairs of converging flat surfaces.

Each bearing 23 and the associated counter-bearing 24 act on substantially the same portion of the plate 21.

The plate 22 associated with the armature 18 is similarly supported between a pair of bearings 25 and associated counter-bearings 26 in the lower cover 7 and in the support ring 6, respectively (FIG. 5).

As can easily be seen in FIG. 4, the ends of the arms 17*a*, 17*b* of the armature 17 and of the arms 18*a*, 18*b* of the armature 18 are force-fitted in the corresponding seats 10*c*, 10*d* of the diaphragm 10 and 11*c*, 11*d* of the diaphragm 11, respectively.

The plates 21 and 22 act essentially as resilient beams for enabling the associated armatures to move along the axis A—A.

The armatures 17 and 18 and the air gaps defined between the ends of their respective arms together form a magnetic circuit which is affected by the flux generated by the control solenoid 15. When the solenoid is excited, an electrical current passes through it and the magnetic field generated causes the the armatures to be mutually attracted and to move towards each other. The plates 21 and 22 to which the armatures are connected bend resiliently ready to return the armature towards it original position as soon as the excitation of the solenoid 15 ceases.

In operation, the intermittent excitation of the solenoid 15 thus causes the armatures 17 and 18 correspondingly to move in opposition and the diaphragms 10 and 11 correspondingly to vibrate in counterphase, the frequency of the vibrations being determined by the laws of the machanics of vibrations and depending on the equivalent oscillating masses and the elastic constants of the plates as well as on the characteristics of the sound-emission duct.

The intermittent excitation of the solenoid 15 is achieved by the electrical switching device which will now be described.

As can be seen in FIG. 5, a metal plate, indicated 30, with an almost central hole 31 is fixed in the support disc 8 (for example, by co-moulding). A first end of a flexible metal plate 33 is anchored to the plate 30 at 32. The other end of the plate extends beyond the hole 31 in the plate 30 and terminates in a projection 34 facing the plate and formed, for example, by punching.

The plate 21 which carries the armature 17 carries an electrical contact, indicated 35, which faces the hole 31 in the overlying plate 30 carried by the support ring 8.

The plate 33 also carries an electrical contact, indicated 36, which faces the contact 35 carried by the plate 21.

The arrangement is such that, at rest, (that is, when the solenoid is not excited) the contacts 35 and 36 touch. In this situation, the projection 34 on the end of the plate 33 is spaced from the plate 30. Moreover, the plate 33 is in a resiliently-loaded condition which tends to keep the contact 36 against the contact 35.

The contacts 35 and 36 together form a normally-closed electrical switch which is connected (in a manner not shown) in series with the control winding or solenoid 15.

In operation, when a current is made to pass through the switch and the control solenoid 15, the armatures 17, 18 move towards each other as a result of the magnetic field generated, causing the associated plates 21 and 22 to bend resiliently. In particular, the bending of the plate 21 moves the contact 35 away from the contact 36 and opens the switch constituted by the contacts. In this condition, the projection 34 on the plate 33 abuts the stop plate 30. The interruption of the supply to the solenoid 15 causes the magnetic attraction between the two armatures to cease and the plates 21 and 22 associated therewith thus move the armatures apart. The contact 35 is returned into engagement with the contact 36, causing a further excitation of the control solenoid 15. This operation is repeated cyclically throughout the period of time during which the horn is activated.

As can be seen in FIGS. 4, 5 and 9, in particular, the shaped elements 2 and 3 which together form the casing of the horn have coaxial inner walls 2*a*, 3*a*, and outer walls 2*b*, 3*b*.

As can be seen in FIG. 5 in particular, the ends of the inner and outer walls 2*a*, 2*b* and 3*a*, 3*b* of the shaped elements are interconnected adjacent the diaphragms 10 and 11 by respective annular walls or partitions, indicated 40 and 41.

An annular compartment, indicated 50, is thus defined between the support ring 5, the two coaxial walls 2*a* and 2*b*, and the annular wall 40 of the shaped element 2.

Similarly, a second annular compartment, indicated 51, is defined between the lower support ring 6, the coaxial walls 3*a* and 3*b*, and the annular partition 41 of the shaped element 3.

As can be seen in the right-hand portion of FIG. 4 in particular, a hole 60 in the annular end wall 41 of the shaped element 3 and in its inner wall 3*a* communicates with the variable-volume chamber 12 between the diaphragms 10 and 11 through two corresponding notches in the peripheries thereof. The variable-volume chamber thus communicates with the space 51 between the coaxial walls of the element 3 through the hole 60. The hole 60 can also be seen in FIGS. 3 and 9.

Two adjacent, transverse, curved deflecting surfaces, indicated 61 and 62 in FIGS. 8 and 9, are disposed in the annular space 51 defined between the two coaxial walls of the element 3.

The surface 61 is adjacent an edge of the hole 60.

In operation, the air which is pumped as a result of the vibrations of the two diaphragms forming the variable-volume chamber 12 is propagated through the hole 60 towards the annular compartment 51, as indicated by the arrow F1 in FIG. 9. The surface 61 which, conveniently, is arcuate, as shown in the drawings, deflects the air-flow into the annular duct 51, as indicated by the arrow F2 in FIG. 9. The air then flows along this duct, as indicated by the arrows F3 and F4 in FIG. 9 until it reaches the deflecting surface 62. This wall deflects the air towards two corresponding holes 63 and 64 in the adjacent annular walls 40 and 41 of the shaped elements 2 and 3. The air thus reaches the duct 50 of the shaped element 2 as shown by the arrows F5 and F6 of FIG. 9. The holes 63 and 64 are conveniently immediately adjacent the hole 60.

In the annular duct 50 of the shaped element 2 is a curved, transverse deflecting wall, indicated 65 in FIGS. 8 and 9. In operation, this surface directs the air which arrives in the duct 50 defined in the shaped element 3, as indicated by the arrow F7 of FIG. 9.

As can be seen in FIGS. 1 to 4 and 9, the shaped elements 2 and 3 together form an outer trumpet, generally indicated 70, like an exponential horn, which communicates with the duct 50 defined in the space in the upper shaped element 2.

As shown in FIG. 9, the cylindrical outer wall of the upper shaped element 2 has a gap, indicated 71, a certain angular distance from the deflecting surface 65 in the sense in whkich the air is propagated. An almost tangential partition 72 extends between the two coaxial walls 2*a* and 2*b* of the shaped element, adjacent the gap. Starting from the region of the gap 71, the cylindrical outer wall 2*b* of the upper shaped element 2 is connected to a further outer wall 2*c*. This wall lies externally beside the wall 2*b* and is spaced progressively therefrom so as to define an exponentially flared duct therewith. The lower shaped element 3 correspondingly has a further outer wall portion 3*c* (FIGS. 4 and 9) which follows the shape of the wall 2*c* of the overlying shaped element 2.

In the embodiment illustrated, the height of the wall 2*c* of the shaped element 2 is substantially constant, whereas the height of the wall 3*c* of the shaped element 3 decreases progressively. These walls define, with further wall portions 2*d* and 3*d* (FIGS. 4 and 9), a terminal sound duct like an exponential horn. This terminal sound duct opens into the outside environment which is reached by the air vibrations which are produced in the variable-volume chamber 12 in operation and are then propagated through the ducts 51 and 52 in the spaces in the shaped elements 2 and 3.

The arrangement of the ducts is such that the column of air follows an almost spiral path, the length of which, as is known, is inversely proportional to the frequency of the sound desired. According to the frequency desired, the path may extend for a fraction of a turn or for up top one or two turns around the loginitudinal axis of the body of the horn. This arrangement provides a sound-duct which may be of a considerable overall length whilst the dimensions of the horn are kept as small as possible.

The embodiment of the horn described above has many advantages.

In the first place, as already stated, with this horn, the presence of two opposed masses which oscillate in counterphase means that there is no appreciable reaction of the support casing against the bodywork of the motor vehicle and the fixing of the horn is therefore no longer absolutely critical.

In the horn described above, the resilient plates 21 and 22 associated with the armatures 17 and 18 are less stressed, for a given air gap, than the corresponding resilient biasing members in conventional horns with single diaphragms.

The structures of the diaphgrams 10 and 11 and, in particular, their central, relatively stiff, disc-shaped portions, enables a better "pumping" action to be achieved for a given amplitude of oscillation and the volumes of air displaced are almost three times the volumes which could be displaced by conventional conical diaphragms.

The casing of the horn can be made entirely of plastics material. The horn is thus better protected from and more resistant to external atmospheric agents. This characteristic is also particularly appreciated by vehicle builders, whose approval tests for horns require them to be able to withstand log periods of exposure to corrosive agents such as saline mists, saline-acetic mists, etc.

Moreover, the plastics casing does not require expensive surface treatment and can be made in any colour.

The structure of the support casing is greatly simplified. During manufacture, the casing is formed by the assembly in succession of a limited number of easily-handled, preassembled subunits. The assembly is achieved by means of successive welding operations, for example, by utltrasonic welding, or by gluing, or by other suitable systems.

The ends of the metal plates 21 and 22 which act as springs perferably, but not necessarily, bearn on the support structure in the manner described above. By virtue of this characteristic, the elastic constants of the plates, on which the frequency of the sound desired depends, are determined in practice solely by the characteristics of the material and by their geometrical dimensions and can thus be reproduced with a high degree of consistency and uniformity during mass-production.

As is known, the frequency of the vibration of a plate spring depends on the square root of its elastic constant (as well as on the oscillating mass).

Since the elastic constants of the plates 21 and 22 of the horn can be reproduced very consistently and uniformly, the plates 21 and 22 of the horns thus produced do not, in practice, need to be calibrated to ensure that the frequency of the sound emitted is consistent. This represents an advantage of considerable importance in comparison with conventional horns in which the elastic constants of the diaphragms, which are subject to very complex behaviour from a vibrational point of view, have to be calibrated batch by batch or even item by item.

In the horn described above, which includes two diaphragms (which, for resilience purposes, may be inert) and two plates 21 and 22 on which the resilient behaviour during vibration mainly depends, the plates are connected to the support casing by connections with bearings.

In particular, this enables the ends of the plates to be supported between parts which are made of plastics material, with advantages and benefits from the points of view of structural simplicity, a reduction in weight, and lower production costs.

The device which controls the switching of the supply current to the control solenoid 15, in the horn described above, is self-adjusting so that the horn is in fact self-calibrating.

The particular shape of the sound-duct in which the column of air vibrates enables the duct to be of a considerable length whilst the device as a whole is extrememly compact from a dimensional point of view.

Naturally, many variants of the embodiment described above are possible.

Thus, for example, instead of a single control solenoid, there could be two solenoids, fixed inside the support casing around the central arms of the two opposed armatures which are intended to oscillate in counterphase. The solenoids, suitably interconnected in parallel or in series, would be excited intermittently, preferably by a single switching device. The shape of a possible further control solenoid is shown in broken outline in FIGS. 4 and 5.

In a further variant, the resilient plates 21 and 22 described above may be replaced by plates having the shapes shown by way of example in FIGS. 10 to 12.

These drawings show an elongate, substantially rectangular plate, generally indicated 80, with two flat end portions 81 whith respective holes 82 for the passage of fixing means such as nails or rivets.

The plate 80 has an intermediate portion 83 with a central depression 84 which is intended to give it an overall thickness such that it can be force-fitted in the pack of plates constituting an armature of the horn. Facing U-shaped bends 85 are also stamped in the central portion 83 of the plate to make it stiffer and to reinforce it in correspondence with holes 88, in one of which an electrical contact, such as that indicated 36 above, is intended to be fixed. The ends of the U-shaped bends are connected to linear bends 86 transverse the longitudinal axis of the plate for retaining and centering the pack of plates constituting an armature.

Between the central portion 83 and the flat end portions 81, the plate has two portions 87 with corrugated profiles (FIG. 11) which are intended to allow the central portion of the plate to travel a considerable distance without excessively stressing the end portions 81 which cooperate with the support structure.

By virtue of the conformation described above, although the plate of FIGS. 10 to 12 is intended to be fixed firmly to the support structure, it enables a certain uniformity of the elastic constant to be maintained at the production state, and hence a certain uniformity of the vibration frequency of the horns produced.

This type of plate can also be used with connection of the type with bearing surfaces, described above (in this case the holes 82 are not necessary).

Naturally, the principle of the invention remaining the same, the forms of embodiment and details of construction may be varied widely with respect to those described and illustrated purely by way of non-limiting example, without thereby departing from the scope of the present invention.

I claim:

1. A motor-vehicle horn including:

a support casing (1 to 3), a diaphragm (10) connected peripherally to the casing (1 to 3) and constituting one wall of a chamber (12) of variable volume, a sound-emission duct (51, 50, 70) communicating with the chamber (12), at least one control solenoid (15) fixed in the casing (1 to 3), and a first ferromagnetic armature (17) which is connected to the diaphragm (10) and at least part of which extends movably in the solenoid (15) so as to cause the diaphragm (10) to vibrate along a predetermined axis (A—A) when the control solenoid (15) is excited by an intermittent current, a second diaphragm (11) which is also connected peripherally to the casing (1 to 3) and is spaced from and faces the first diaphragm (10) so as to constitute a second wall of the variable-volume chamber (12), and a second movable ferromagnetic armature (18) connected to the second diaphragm (11), facing the first armature (17) and separated therefrom at least by an air gap, the second armature (18) being adapted, together with the first armature and an air gap, to form a magnetic circuit which is affected by the flux generated by the at least one control solenoid (15) so that the intermittent excitation of the solenoid (15) corespondingly causes the armature (17, 18) to move in opposition and the diaphragms (10, 11) to vibrate in counterphase.

2. A horn according to claim 1, wherein each armature (17, 18) is suspended in the support casing (1 to 3) by a respective elongate, flexible plate (12, 22) the ends of which are connected to the casing (1 to 3) and which extends substantially perpendicular to the line of movement (A—A) of the associated armature (17, 18), each of the plates (21, 22) being adapted to act as a resilient biasing member acting on the associated armature (17, 18) in the opposite direction to the force due to the field generated by the solenoid (15).

3. A horn according to claim 2, wherein the diaphragms (10, 11) are substantially inert from the point of view of resilience.

4. A horn according top claim 2, wherein the flexible plate (21, 22) associated with each armature (17, 18) is driven into a hole or slot (19, 10) in the armature (17, 18).

5. A horn according to claim 2, wherein each plate (21, 22) is of metal.

6. A horn according to claim 2, wherein the ends of the flexible plate (21, 22) associated with each armature (17, 18) are supported onbearings (23, 25) in the casing (1 to 3), the bearings extending substantially perpendicular to the longitudinal axis of the plate (21, 22).

7. A horn according to claim 6, wherein each end of each of the plates (21, 23) is restrained between a bearing (23, 25) and an associated counter-bearing (24, 26) disposed in the casing (1, 3) and acting on substantially the same portion of the plate (21, 22) as the corresponding bearing (23, 25).

8. A horn according to claim 6, wherein each bearing (23, 25) is constituted substantially by an edge formed by two surfaces which converge to form a dihedron.

9. A horn according to claim 8, wherein each counter-bearing (24, 26) is constituted substantially by an edge formed between two surfaces converge which also form a dihedron.

10. A horn according to claim 2, wherein the ends of each of the plates (80) are fixed firmly to the support casing (1 to 3), for example, by nailing or riveting.

11. A horn according to claim 10, wherein each of the plates (80) has two end portions (82) which can be anchored to the support casing ( 1 to 3), a central portion (83) which is force-fitted in the associated armature (17, 18), and a portion (87) with a corrugated profile between each end portion and the central portion.

12. A horn according to claim 1, wherein the at least one control solenoid (15) is coaxial with the axis (A—A) and in that at least one of the armatures (17) is substantially E-shaped with a central arm (17*a*) which extends movably in the solenoid (15).

13. A horn according to claim 12, wherein both the armatures (17, 18) are substantially E-shaped and are arranged with their arms facing and aligned.

14. A horn according to claim 11, wherein the armatures (17, 18) are constituted by insulated packs of plates of equal mass.

15. A horn according to claim 1, wherein each diaphragm (10, 11) has a relatively thick, rigid, central disc-shaped portion (10*b*, 11*b*) with recessed seats or depressions (10*c*, 10*d*; 11*c*, 11*d*) in which the ends of the associated armatures (17, 18) are force-fitted.

16. A horn according to claim 15, wherein between its periphery and its central disc-shaped portion each diaphragm (10, 11) has a thinner, annular, flexible, intermediate portion (10*e*, 11*e*) with a bellows-like, corrugated, radial profile.

17. A horn according to claim 15, wherein each diaphragm (10, 11) is made of a plastic material, such as an acetal resin, which may be toughened.

18. A horn according to claim 1, wherein at least part of the sound duct extends in a space (50, 51) in the support casing (1 to 3).

19. A horn according to claim 18, wherein a cavity (4) is defined in the casing (1 to 3) and the diaphragms (10, 11) are disposed transversely and restrained therein, the cavity (4) having an inner side wall (2*a*, 3*a*) and an outer side wall (2*b*, 3*b*) between which a space with closed ends is defined, at least one partition (40, 41) interconnecting the inner and outer side walls (2*a*, 3*a*; 2*b*, 3*b*) between the ends of the space and dividing the space into first and second annular compartments (51, 50), the inner wall (2*a*, 3*a*) of the cavity (4) having a first duct (60) which puts the variable-volume chamber (12) between the diaphragms (10, 11) into communication with the first compartment (51), the partition (40, 41) having at least one second duct (63, 64) for communication between the first and second compartments (51, 50), and the compartments (51, 50) also having deflecting walls (61, 62, 64) disposed and shaped so that, in operation, the air vibration caused by the diaphragms (10, 11) of the variable-volume chamber (12) is propagated first into the first compartment (51) and then into the second compartment (50).

20. A horn according to claim 19, wherein the second compartment (50) has an air outlet hole (71) which is in the outer wall (2*b*) of the cavity (4) and is connected to a progressively flared terminal duct (70).

21. A horn according to claim 12, wherein the casing (1 to 3) is made of plastics material.

22. A horn according to claim 3, wherein the flexible plate (21) associated with one of the armatures (17) carries a first electrical contact (35), and in that an end of a second flexible plate (33) is connected to the casing (1 to 3) on the opposite side of the armature (17) from the associated plate (21) and carries a second electrical contact (36) which is in contact with the first contact (35) at rest, the first and second contacts (35, 36) forming an electrical switch in series with the control solenoid (15), the arrangement being such that the first and second contacts (35, 36) are in contact and the switch is normally closed when the solenoid is not excited, the excitation of the solenoid (15) causing the switch (35, 36) to open as a result of the resilient deformation of the plate (21) due to the movement of the associated armature (17).

23. A horn according to claim 22, wherein a stop member (30) is associated with the second flexible plate (33) for limiting its displacement towards the other plate (21) which carries the first electrical contact (35).

24. A horn according to claim 23, wherein the second plate (33) and the associated stop member (30) are of metal.

25. A horn according to claim 1, including two control solenoids which are fixed in the casing (1, 3) and within which at least part of the first and second armatures (17, 18) extend.

26. A horn according to claim 25, wherein the solenoids are coaxial and are electrically connected in paralle.

* * * * *